United States Patent [19]

Trucksess

[11] Patent Number: 4,696,239

[45] Date of Patent: Sep. 29, 1987

[54] SECURITY ENCLOSURE FOR TRANSACTION MACHINE

[76] Inventor: A. William Trucksess, 451 Creek Rd., RD #2, Moorestown, N.J. 08057

[21] Appl. No.: 724,461

[22] Filed: Apr. 18, 1985

[51] Int. Cl.[4] ..... G07G 5/00

[52] U.S. Cl. ..... 109/24.1; 109/66; 221/281

[58] Field of Search ..... 109/2, 5, 10, 11, 19, 109/24.1, 66; 221/281, 282

[56] References Cited

U.S. PATENT DOCUMENTS 4,399,755 8/1983 Wiedmann ..... 109/66

4,497,261 2/1985 Ferris et al. ..... 109/2

4,513,670 4/1985 Berman ..... 109/24.1

4,558,650 12/1985 Berman ..... 109/24.1

*Primary Examiner*—Gary L. Smith

*Assistant Examiner*—Neill Wilson

*Attorney, Agent, or Firm*—Morton C. Jacobs; William Freedman

[57] ABSTRACT

An automatic teller machine is provided with apparatus for turning it around a moving axis to turn between its operating user-access position and its service and maintenance position so that the machine can be used in an enclosure of minimum dimensions.

15 Claims, 9 Drawing Figures

SECURITY ENCLOSURE FOR TRANSACTION MACHINE

BACKGROUND OF THE INVENTION

In the past few years there has been a large increased use of the automatic teller machine (ATM), which functions to process automatically bank transactions under computer control. These machines are usually mounted in the outer walls of banks. They provide twenty-four hour service to bank customers by allowing customers to engage in transactions, such as the deposit or withdrawal of funds, without entry into the bank or the need for the services of bank tellers.

When the ATM is mounted in the outer walls of banks, customers have access from the sidewalk and the bank employees have access to the rear of the ATM from the interior of the bank for servicing and maintenance. A locked door in the rear of the machine provides access into the cash box for replacement of the cash that is withdrawn by customers. Bank employees, within the security area of the bank itself, handle large amounts of cash to replenish the machines.

The situation is quite different for ATM's located on islands outside the bank for automatic drive-through banking. The security requirements are much more severe with respect to ATM's mounted on exterior islands versus through-mounted ones in the walls of building. The enclosures must be made strong enough to make intrusion difficult; employees carrying large amounts of cash must have minimal outside exposure, and must get into the enclosure rapidly and must be secure while they are servicing or maintaining the machine.

Prior art enclosures for transaction machines are described in U.S. Pat. No. 4,417,527 to Williams and U.S. Pat. Nos. 4,121,523 and 4,348,966 to Hastings.

An additional problem arises because the islands initially built for drive-through teller banking are generally narrow in width (e.g. about 4 feet) and the enclosures which are mounted on them must be similarly compact. Additionally, minimizing the width of the islands reduces the outside land requirements for a given number of enclosures and their machines, or allows more enclosures and machines to be installed in a given area.

Accordingly, it is among the objects of this invention to provide a new and improved system for drive-through automatic tellering that is highly secure and economically minimizes enclosure dimension requirements.

Another object of this invention is to provide new and improved apparatus for turning an ATM in an enclosure for servicing and maintenance which minimizes the required enclosure width.

Another object is to provide a new and improved ATM turning apparatus in an enclosure that is highly secure during operation of the ATM by customers and during servicing and maintenance of the ATM by employees.

A further object is to provide a highly secure, minimum width enclosure with rapid entrance and egress and minimum outside exposure time to ATM servicing employees handling large amounts of cash.

Another object is to provide a highly secure, minimum-width enclosure with a powered automatic apparatus to rapidly turn the ATM to its servicing and maintenance position and back to its normal operating position.

SUMMARY OF THE INVENTION

In accordance with an embodiment of this invention, a compact enclosure is achieved by means of a special apparatus for turning a transaction processing device for service and maintenance. When the device is an automatic teller machine (ATM) used for drive-through banking, it is particularly constructed to be installed in a secure enclosure on an island adjacent to a bank.

The front of the ATM normally projects through a window in the wide wall of the enclosure which provides access to customers sitting in their vehicles or standing at the ATM. The machine is serviced by turning the ATM approximately at right angles about a movable pivot point through a prescribed path and, thereafter, closing the window.

The apparatus first moves the ATM back a short distance so that the ATM clears the frame of the window while turning. Then the apparatus turns the ATM about the movable pivot point to its servicing and maintenance position, which gives the employee access to the cash box and maintenance controls of the ATM. The pivot moves during turning so that the ATM is able to project through the window to the extent required during turning. This accommodates the diagonal dimension of the ATM in such a way that the width of the enclosure is less than the diagonal dimension of the ATM and but a small amount greater than the depth of the ATM to provide a small clearance at the rear wall of the enclosure.

The turning procedure can be automatic. In a particular embodiment, apparatus is motor driven and operated by a two-position control. In the first position, the employee causes the ATM to be turned approximately 90 degrees to its servicing and maintenance position. A shutter panel is then positioned to cover the access window in the front wall of the enclosure where the front of the ATM was positioned. When servicing or maintenance has been completed, the employee actuates the second position causing the shutter panel to be returned to its normal open position, and the apparatus then turns the ATM back to its normal user-access position.

A low-cost highly secure system is thus provided with minimum exposure to employees carrying large amounts of cash. The width requirement of the enclosure is minimized without resort to complex and costly structures and without sacrifice of overall security for the structure.

The above and other objects of this invention, the various features thereof, as well as the invention itself, may be more fully understood from the following detailed description when read together with the accompanying drawing.

DETAILED DESCRIPTION OF THE INVENTION

Figure 1:
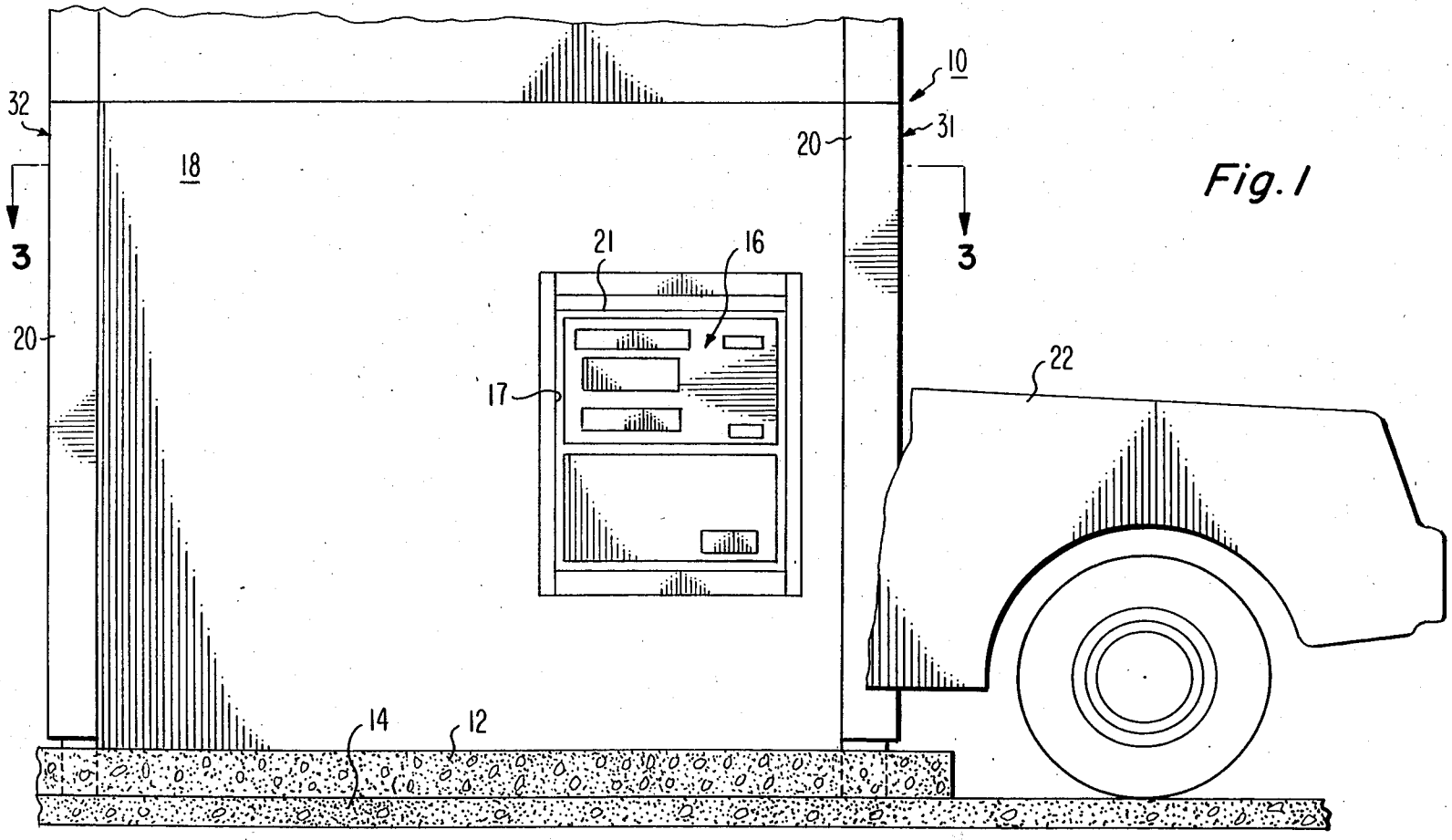
FIG. 1 is an elevation view of the operating side of an enclosure for drive-through banking, in which an ATM is installed and which embodies this invention.
Figure 2:
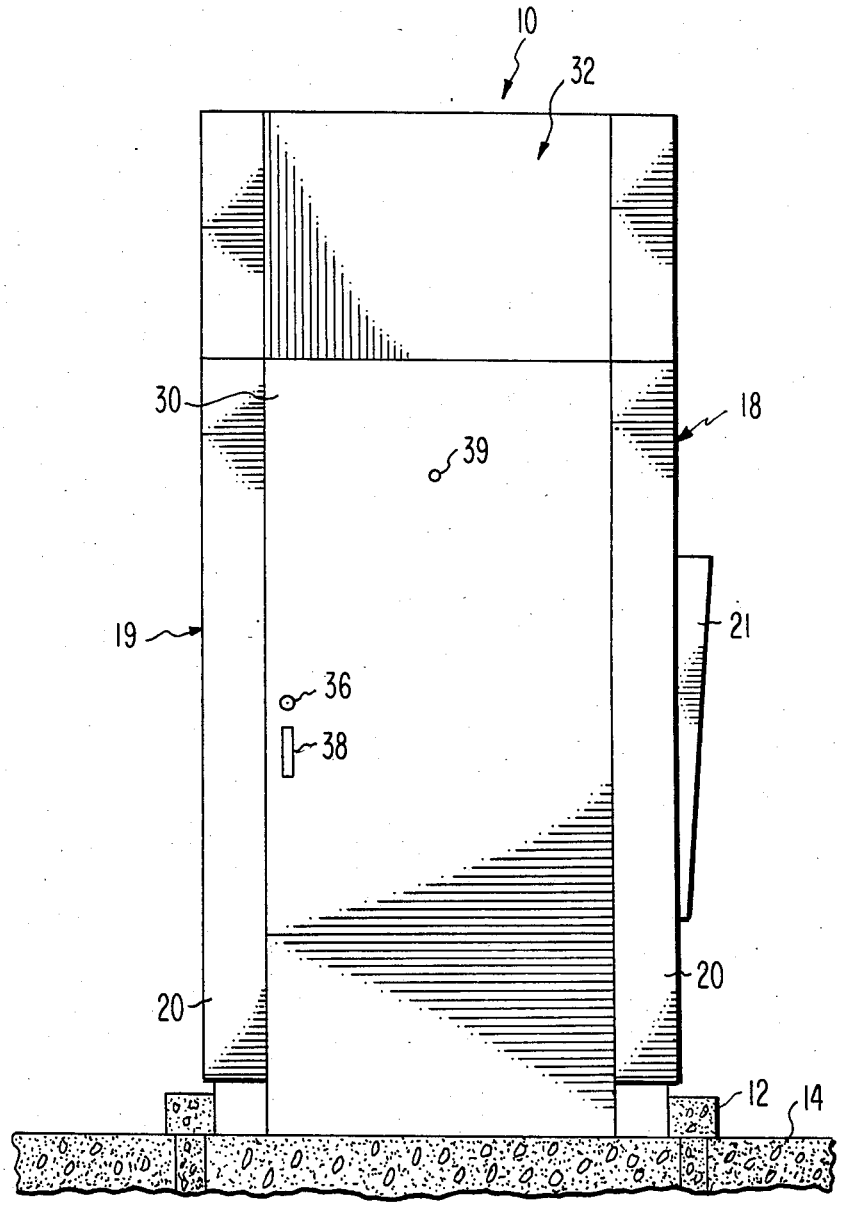
FIG. 2 is an elevation view of the access-door end of the enclosure of FIG. 1.

In the drawing, corresponding parts are referenced by similar numerals throughout.

In FIGS. 1–4, the rectangular enclosure 10 (in a highly secure construction for banking purposes) is emplaced on an island 12 which is set in concrete pavement 14. An ATM 16 is installed in the enclosure 10 and it projects through an access window 17 in front sidewall 18. Removable metal strips 20 cover the corners of the enclosure and are replaceable should they be dented or otherwise damaged during ATM use.

Drive-through banking ATM services are provided to a customer in an automobile 22 who can stop opposite the window 17, through which the operating interface 21 projects, and make transactions including deposits or withdrawals of cash without leaving the vehicle.

The rear of ATM 16 has a hinged door 24 (FIG. 3 and 4) that is opened to gain access to a secure cash box and the operating circuits and devices (not shown) of the ATM for servicing and maintenance. Since large amounts of cash must be periodically deposited into the ATM to replenish the cash box to cover withdrawals, a secure area 26 is provided within the enclosure 10 for the bank personnel servicing the machine. For compactness, the space between the ATM door 24 and the back wall 19 (see FIG. 3 with the ATM in its normal operating condition) is made very small, thus too small to permit opening the door 24 for internal access while the ATM is in its normal position.

Security door 30 (FIG. 2) is installed in end wall 32 and attached by a concealed continuous hinge. Key slot 36 and handle 38 allow access to persons possessing the proper key. For added security, peep hole 39 may be used by persons within the enclosure to assure that the outer area is clear before opening the door or to permit access only to authorized persons deserving entry.

An ATM is a heavy piece of equipment weighing a ton or more and it is mounted on a special turning apparatus 40 (FIGS. 3–6) which includes a rectangular carrier 54 that holds the rectangular base of the ATM. A drive motor 42 when energized rotates and supplies power to turn ATM carrier 54 by means of a chain 45.

Figure 3:
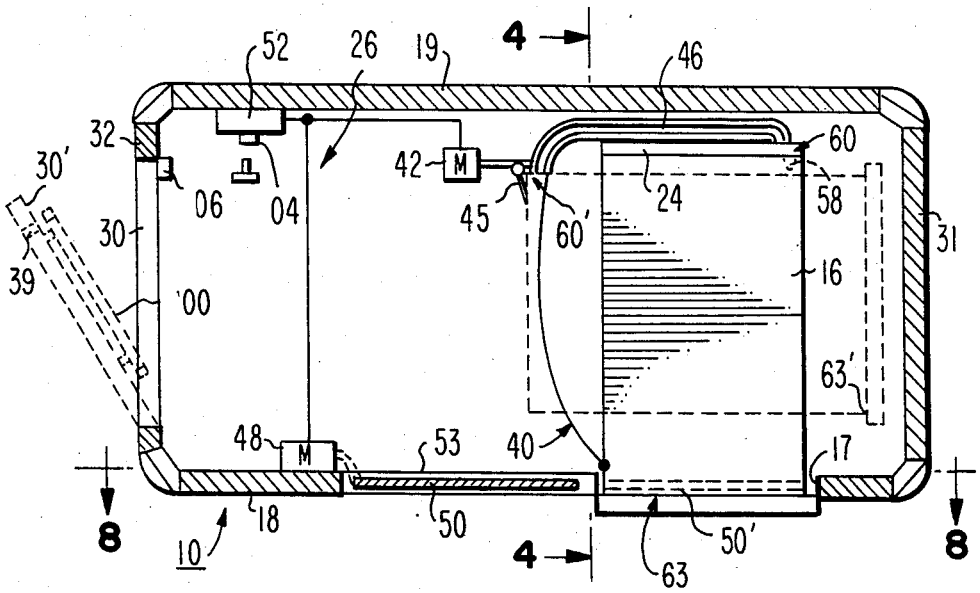
FIG. 3 is a top view of the interior of the enclosure taken along the line 3—3 of FIG. 2 and illustrating the ATM in operating position.

The rectangular periphery of ATM 16 in its normal operating position (i.e. when in use by bank customers) is shown (FIG. 3) in solid lines. When turning apparatus 40 has turned ATM carrier 54 about 90° or more the ATM is oriented for servicing and maintenance, as shown in FIG. 3 with the periphery of ATM 16 in broken lines. When ATM 16 reaches its servicing and maintenance position, a motor 48 rotates and supplies power to move shutter panel 50 (to the right along slide 53 to close access window 17. Closure panel 50 is shown with dashed lines in its closed service position and referenced as 50'.

When servicing or maintenance is complete, motor 48 is rotated in the reverse direction supplying power to move closure panel 50 back to its original position (to the left) to open window 17. Carrier drive motor 42 is then rotated in the reverse direction to turn ATM 16 back to its operating position, providing access to customers at ATM interface 21.

Figure 9:
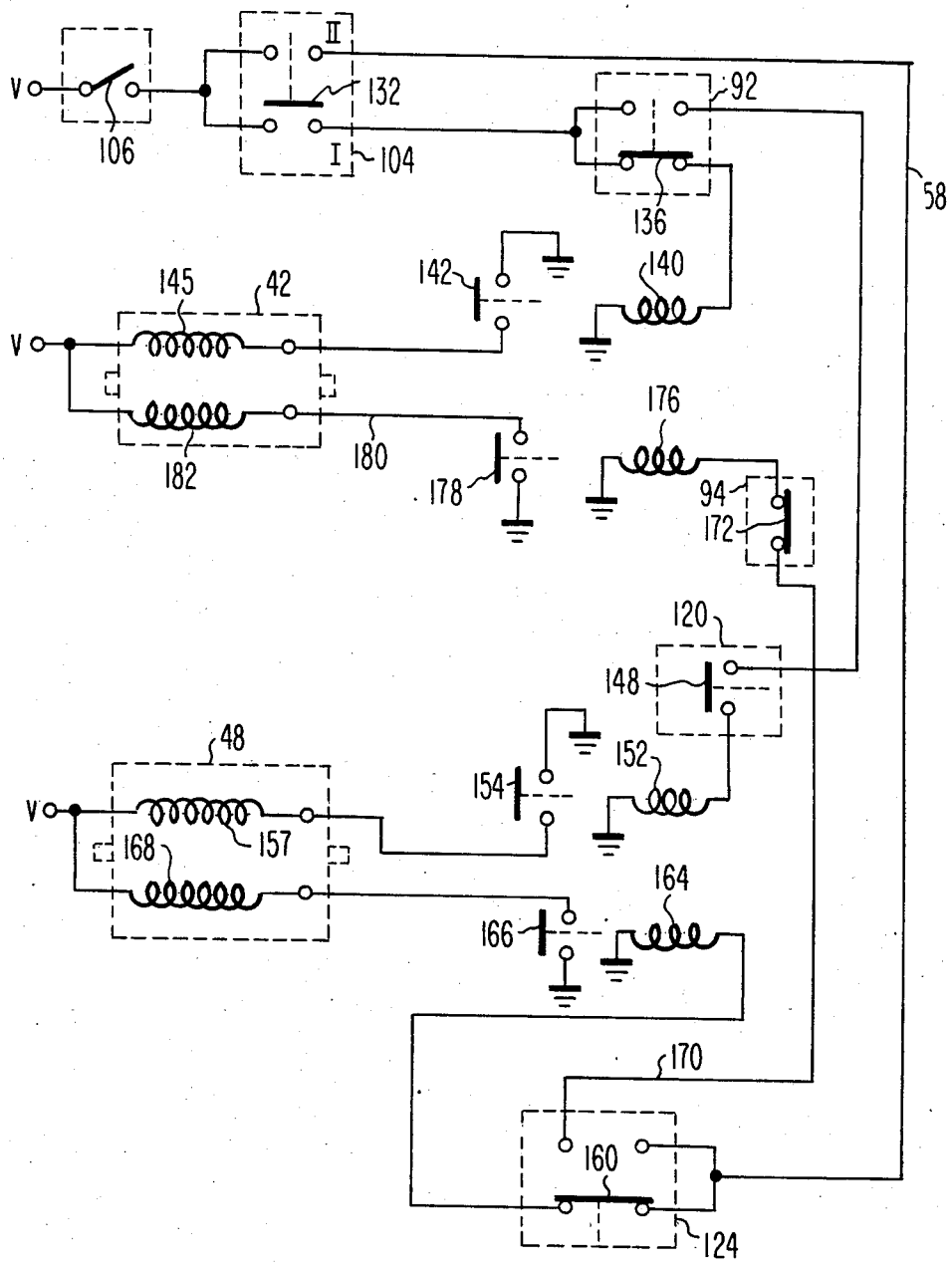
FIG. 9 is a circuit diagram of the control and drive system for operation of the turning and related apparatus of this invention.

The construction and operation of control box 52 which sequences the operation of motor 42 and 48 by means of limit switches is described in detail below with reference to FIG. 9.

The ATM carrier 54 of turning apparatus 40 has mounted on the underside thereof a bearing 58 which is positioned within, moves along and is guided by positional track 46 fixed to base assembly 68 when ATM 16 is being turned. Track 46 is fixed to base assembly 68.

During turning, ATM carrier 54 pivots about the axis of a pivot bearing 62. The latter pivot bearing is positioned within and is constrained by pivot track 64. Pivot bearing 62 rides along pivot track 64 when ATM carrier 54 is being turned.

Figure 5:
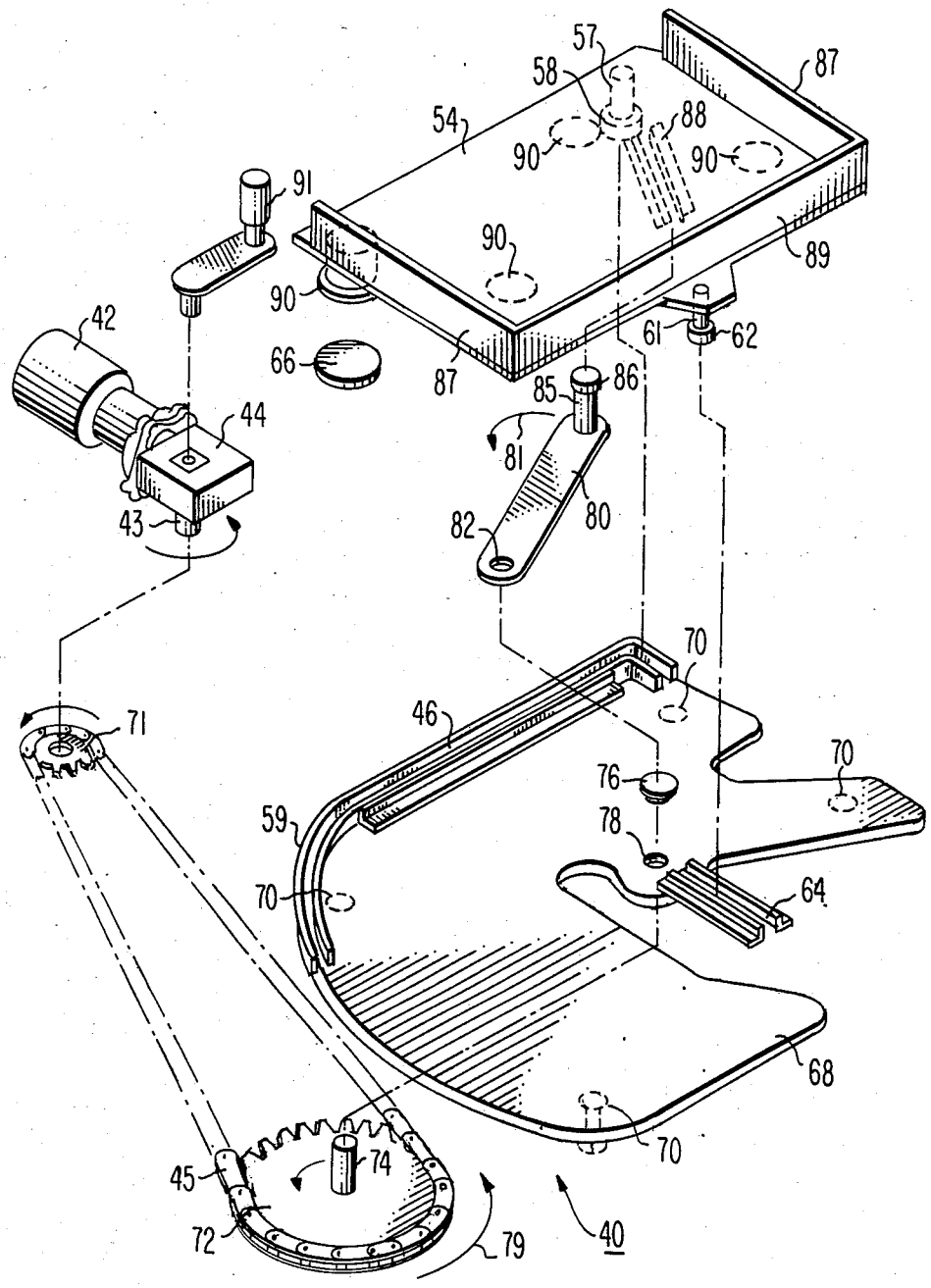
FIG. 5 is an exploded view of the various components of a turning apparatus for the ATM shown in FIG. 4.
Figure 6:
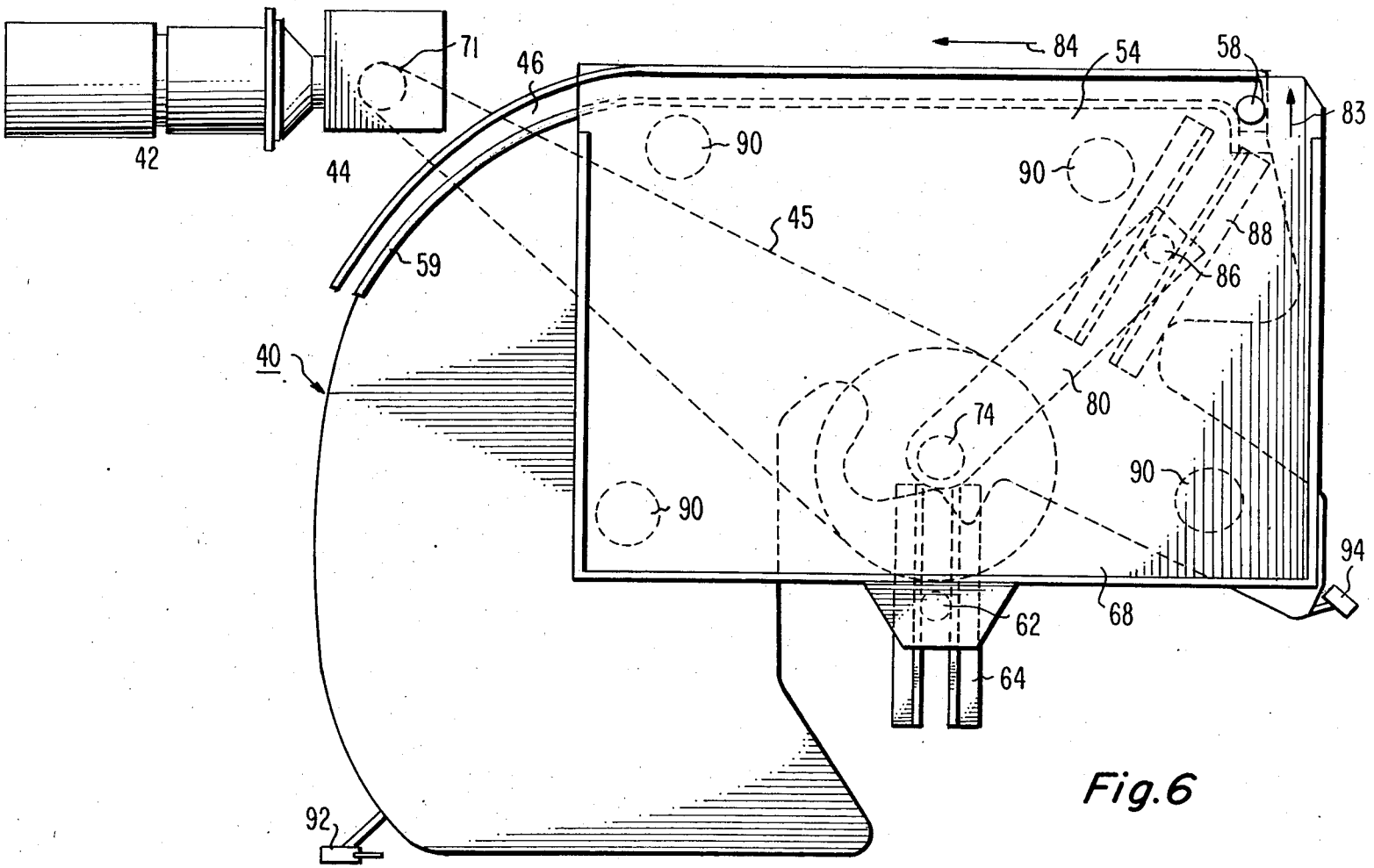
FIG. 6 is a top view of the turning apparatus of FIG. 5 in assembled condition.

Teflon pads 66 attached to legs on the underside of carrier 54 slide on the flat upper surface of base assembly 68 when ATM 16 is turned. Turning apparatus 40 rests on leveling bolts 70 which are attached to the underside of base assembly 68 and sit on the floor of the enclosure. A variably-coupled drive between motor 42 and carrier 54 is shown in FIGS. 5 and 6.

Figure 4:
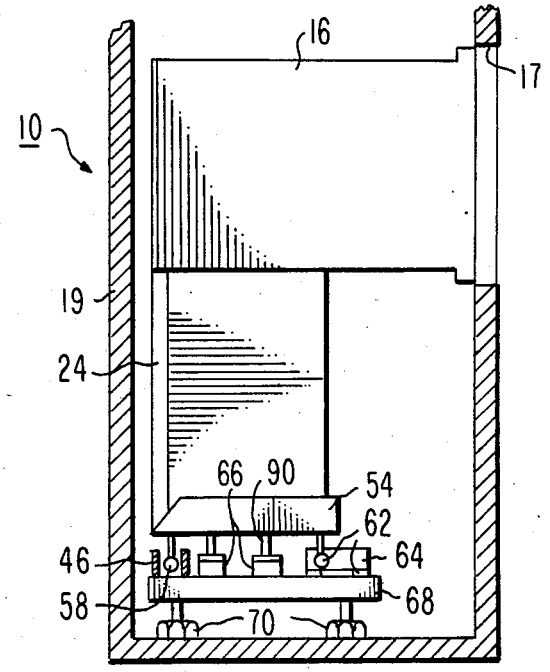
FIG. 4 is an elevation view of the interior of the enclosure taken along the line 4—4 of FIG. 3 and showing the side of the ATM moved back from operating position.

To control the turning path of the ATM carrier 54, the positional track 46 extends generally parallel to the rear wall of the rectangular enclosure 10. The bearing 58 at the right-rear corner 60 of the ATM and its carrier 54 is guided by that track 46 as the carrier is turned by the motor 42 around the pivot axis of pivot bearing 62 (FIGS. 3 and 4). The latter pivot at the center front of carrier 54 is free to slide along and within the pivot track 64. Thus, when the ATM carrier is driven from its normal operating position, track 46 constrains the guided bearing 58 at the carrier's and the ATM's right-rear corner 60. That constraint, in turn, guides that ATM corner 60 to move substantially parallel to the rear wall, ending up at the service position 60'. The left-front corner 63 of the ATM is free to turn about pivot bearing 62 and moves out through the open window 17 in the front wall 18 and back in to end up at position 61'. In this turning movement, the major dimension is the diagonal between these two corners 60 and 63 of the ATM. Since a substantial part of that diagonal (during this variable-axis turning) moves through window 17 and outside of the enclosure 10, the width of the enclosure can be made substantially less than the diagonal of the turning ATM. In contrast, in rotation about a fixed axis, the minimum width of the enclosure would ordinarily be this ATM diagonal.

The axis of pivot 62 varies in position as the pivot moves back and forth in its track 64. The positional track 46 determines the reciprocating movement of pivot bearing 62 in its track 64. At the ATM's normal operating position, the positional track 46 has a bend extending forward where its bearing 58 then rests. The drive motor 42 moves the ATM a short distance back out of its window with bearing 58 guided by track 46. Likewise, pivot track 64 permits pivot bearing 62 to move back. The latter pivot 62 moves forward and then back as guided bearing 58 traverses track 46. At the other end of positional track 46, a bend 59 in that track guides the bearing 58 to turn the ATM sharply into its final position for service and maintenance.

The drive motor 42 is connected to the ATM carrier 54 by a yieldable coupling to accommodate the variable-axis turning of the carrier. As described below, a drive bearing in a drive track is used for this coupling.

When the drive motor 42 for forward rotation is energized, shaft 43 from speed reducer 44 rotates in the direction shown by the arrow, turning sprocket wheel 71, chain 45 and sprocket wheel 72. Keyed shaft 74 on sprocket wheel 72 is positioned through bushing 76 in hole 78 in base assembly 68, and rotates in the forward direction as shown by arrow 79. One end of drive arm 80 is locked to shaft 74 through keyed hole 82, to be turned in a corresponding direction shown by the arrow 81. A drive bearing assembly is mounted on the other end of drive arm 80, and comprises drive bearing shaft 85 and drive bearing 86. When turning apparatus 40 is assembled, drive bearing 86 is positioned within drive track 88 mounted to the underside of carrier 54.

Hand crank 91 may be used to turn carrier 54 when motor 42 is inoperative or power to motor 42 is interrupted. Hand crank 91 is specially slotted and kept in the possession of authorized users only for security purposes.

Also mounted on the underside of carrier 54 is the carrier-guiding bearing 58 and bearing shaft 57 and the pivot bearing shaft 61 and pivot bearing 62, which are described above. The carrier 54 has upstanding sides 87, 89 on three sides within which the ATM sits. Pivot bearing 62 is located at about the middle of the front side 89.

Legs 90 extend from the underside of carrier 54 and Teflon pads 66 are attached to the ends of those legs 90. When turning apparatus 40 is assembled, Teflon pads 66 rest on and slide on the upper flat surface of base assebly 68 and slide to pivot sliding and turning support as carrier 54 turns.

Legs 90 carry the weight of carrier 54 and ATM 16 when it is mounted on carrier 54 and Teflon pads 66 are in sliding contact with the upper surface of base assembly 68. This Teflon pad construction is effective in supporting the thousand-pound weight of the ATM in sliding movements over the base assembly 68 that may change rapidly as the ATM is turned from one position to another. The shape of base 68 is cut to remove metal not serving any function.

When assembled carrier 54 (FIG. 6) is positioned so that the guide bearing 58, pivot bearing 62 and drive bearing 86 are placed within their respective tracks 46, 64, and 88. When shaft 43 extending from speed reducer 44 rotates in the direction shown (FIG. 5) bearing 86 applies a turning force, via track 88, to carrier 54. The latter begins to turn about pivot bearing shaft 61 in a path determined by positional track 46. That is, the right hand corner 60 of ATM 16 moves generally parallel to the rear wall 19 of the enclosure 10 (FIGS. 3 and 7).

The initial motion of carrier 54 from the normal position is to the rear as shown by arrow 83 (FIG. 6), which identifies the initial path of bearing 58. This moves ATM 16 back slightly so that the front of ATM 16 clears access window 17 in front sidewall 18 and can turn through that window. As the drive bearing 86 continues to exert turning force on track 88, bearing 58 moves along positional track 46 in a path shown by arrow 84. Bearing 58 travels parallel to rear enclosure wall 19 along most of track 46 and turns with the track to complete the turning of the ATM through 90' or more as desired. When the servicing and maintenance position of the ATM is reached, the carrier 54 is oriented at about 90' to the normal position shown in FIG. 6. Limit switch 92 is fixed to base assembly 68 and is tripped by carrier 54 when ATM 16 reaches its servicing and maintenance position. Limit switch 94 is also fixed to base assembly 68. It is tripped by carrier 54 when ATM 16 returns to its operating position.

Figure 7:
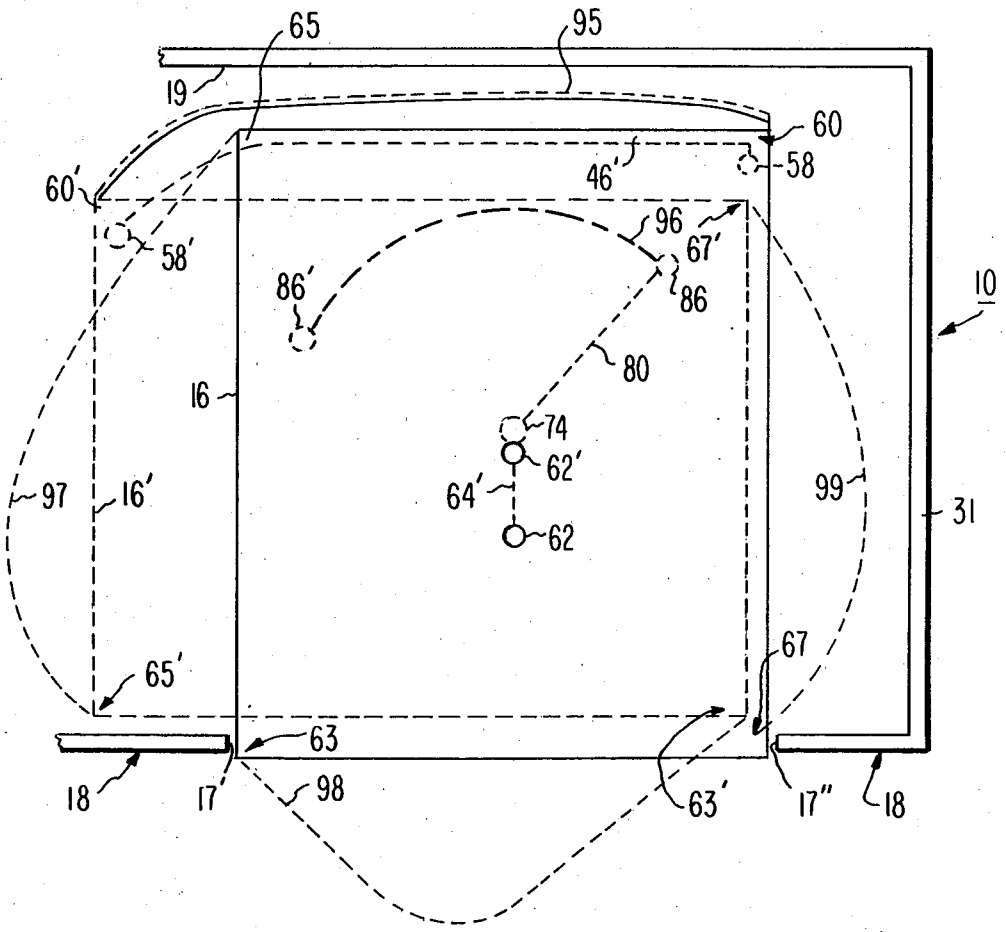
FIG. 7 is a schematic diagram of the paths followed by the corners of the ATM with relation to the enclosure sidewalls of the enclosure of FIG. 3 when turned by the turning apparatus of FIG. 6.

FIG. 7 shows locations of the diagonally-opposite corners 60 and 63 of ATM 16 in its normal operating position and, those corners 60' and 63' in its servicing and maintenance position. Drive bearing 86 transcribes an arc 96 about keyed shaft 74 as it moves from its normal position to its location 86' in the servicing position. Bearing 58 moves along positional track 46 in a path 46' largely parallel to rear sidewall 19 of enclosure 10 to location 58', and right-rear corner 60 of the ATM moves along path 95 generally parallel to path 64'. Pivot bearing 62 moves along a path 64' determined by pivot track 64 as bearing 62 reciprocates between extreme locations 62 and 62'. Bearings 58, 86, and 62 are positioned generally along a straight line; this alignment tends to minimize the force required to turn carriage 54.

The dash-line path 98 taken by the left front corner 63 of ATM 16 extends from its normal location to its servicing location. The path 98 projects further forward of front sidewall 18, through the access window 17 defined by points 17' and 17'' than it would if ATM 16 were rotated about a fixed axis; the latter axis would be at the intersection of the diagonals of the ATM rectangle 16 and with the diagonal as a fixed diameter that produces a circumscribed circle. The width of the enclosure 10 between front and rear walls 18 and 19 using a varying pivot axis as described above is substantially less than that required for rotation about a fixed axis. Similarly the unusable cul-de-sac space between the ATM and end wall 31 (traversed by corner 67 along path 99 to service position 67) is made to be less by turning the ATM about a varying axis as described above than it would be where the ATM is rotated about a fixed axis. Thus, in both respects there is greater efficiency in the use of interior enclosure space.

Figure 8:
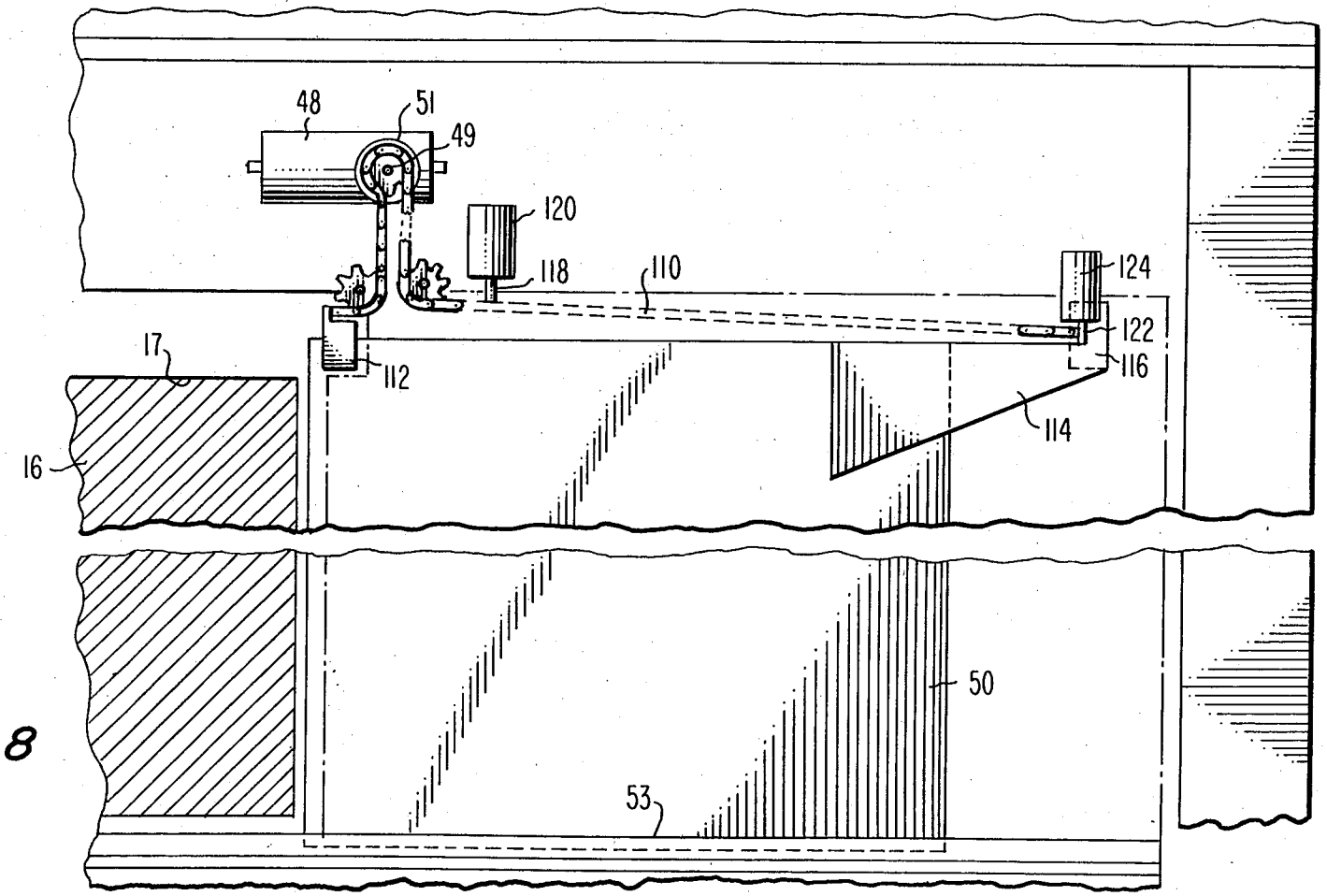
FIG. 8 is an interior view of the front sidewall of the enclosure taken along the line 8—8 of FIG. 3.

The interior of enclosure 10 used by service personnel is shown in FIGS. 3 and 8. The security entrance door 30 has a crash bar 100 which releases the door lock when it is pressed forward to allow for rapid, easy exit from enclosure 10. When security door 30 is not fully closed, interlock 106 disconnects the power to a control box 52.

Control box 52 is mounted onto rear sidewall 19. To turn ATM 16 to its servicing and maintenance position a key is inserted into key switch 104, and turned clockwise and held at position-I. Motor 42 is energized to drive turning apparatus 40 and turn ATM 16 counterclockwise. When the turning operation is completed, the forward winding of motor 48 is energized causing closure panel 50 to move forward to close access window 17 in front sidewall 18 of enclosure 10.

After servicing or maintenance is complete, the key is turned reversely and held at position-II which energizes motor 48 for reverse of operation moving closure panel 50 back to its original unshuttered position. Motor 42 is then energized to turn ATM 16 back to its operating position.

A specially slatted hand crank similar to hand crank 91 is also available for shutter motor 48 as back-up if the motor is inoperative or its power is interrupted.

Access window 17 (FIG. 8) is filled with ATM 16 in its operating position, and closure panel 50 is positioned to the side of access window 17. When the key inserted in key switch 104 is turned and held in position-I, the ATM is first turned to its servicing and maintenance position. Shutter motor 48 is then energized, causing shaft 49 mounted to speed reducer 51 to rotate counterclockwise. Chain 110, which is connected at its ends to brackets 112 and 114, is thereby fixed to the end corners of panel 50. As chain 110 is moved to the left, it drives, in turn, closure panel 50 to the left closing access window 17. When closure panel 50 reaches its left-most position, tripping extension 116 (mounted on bracket 114), displaces rod 118 to the left to operate switch 120.

After servicing or maintenance is complete, the key in key switch 104 is turned to position-II. This energizes the reverse winding of motor 48 causing shaft 49 to rotate clockwise (FIG. 8). Chain 110 and, therefore, closure panel 50 are driven to the right, opening access window 17. When closure panel 50 reaches its right-most position, trip extension 116 displaces rod 122 to operate limit switch 124. This cuts off power to the reverse winding of motor 48 and energizes motor 40 for reverse drive to turn the ATM back to its operating position.

As previously discussed, an automatic control system is provided, with a manual back-up, for turning ATM 16 and opening and closing the access window 17 through which the user operates the ATM. FIG. 9 is a schematic diagram showing the elements and interconnections of the control system.

Voltage is applied through interlock switch 106 to terminals of key switch 104. When a key is inserted into key switch 104 and turned counterclockwise and held at position-I, as shown in FIG. 9, movable contact 132 supplies power, via movable contact 136 of carrier limit switch 92, to energize relay 140. Movable contact 142 connects electrical ground to complete the circuit energizing forward winding 145 of motor 42.

Motor 42 applies power to cause turning apparatus 40 to turn the ATM from its operating position to its servicing and maintenance position. Limit switch 92 which is mounted on base assembly 68 (FIG. 6) of turning apparatus 40 is tripped by carrier 54 when the ATM reaches its servicing and maintenance position. This causes movable contact 136 to switch to the opposite contacts, thereby de-energizing relay 140 and removing power from winding 145 to stop the turning of ATM 16.

Moving contact 136 then applies voltage through normally-closed limit switch 120 (FIG. 8) to relay 152. The latter is thus energized and its movable contact 154 applies power to forward winding 157 of shutter motor 48.

Motor 48 causes closure panel 50 to move to the left (FIG. 8) to close access window 17 in front sidewall 18 of enclosure 10. When the closure panel reaches its closed-position, limit switch 120 is tripped de-energizing relay 152 and breaking the ground connection to forward winding 157, which stops motor 48.

The ATM is now in a position for servicing or maintenance by personnel in secure enclosure 10. When the task is complete, the key in control box 52 is turned and held at position-II. Movable contact 132 applies voltage to line 158 and through now-actuated movable contact 160 of limit switch 124. This voltage energizes relay 164 and its movable contact 166 connects ground to reverse winding 168 of motor 48. The latter moves closure panel 50 back to its original position opening the access window. When closure panel 50 reaches its right-most position (FIG. 8) limit switch 124 is tripped. This actuates movable contact 160 to de-energize relay 164 and reverse winding 168 of motor 48, and motion of closure panel 50 stops with the window open.

Movable contact 160 of limit switch 124 now applies voltage to line 170, and via contact 172 of limit switch 94, to energize relay 176. The latter causes movable contact 178 to energize reverse winding 182 of turning motor 42. The latter applies power to turning apparatus 40 to turn the ATM back to its original operating position. When the ATM reaches its operating position, carrier 54 trips limit switch 94 (FIG. 6) and its movable contact 172 de-energizes relay 176 and reverse winding 182. Thereby, motor 42 stops with the ATM at rest in its operating position.

Thus, the key switch 104 enables servicing and maintenance personnel to automatically turn ATM 16 between its operating and servicing and maintenance position and to move closure panel 50. Access window 17 is opened and closed in proper sequence coordinated with the turning of ATM 16.

Thus, in accordance with this invention, a new and improved security enclosure is provided. The ATM is rotated within a compact enclosure of minimal width. Thereby existing drive-through islands can be converted to ATM, and new islands built with efficient land use. The ATM can be serviced quickly by personnel under full security. The only movement required of the enclosure walls for servicing is that of the window shutter. Automatic motor drive under security control is provided for fast operation, and a manual crank is available if power or a motor breaks down. The security enclosure of this invention is particularly adapted for structures using drive-through banking. This security enclosure is also specially adapted for structures intended for walk-up banking; such structures may be self-contained units remote from a bank or otherwise part of a banking building. In addition, the security enclosure may be used for off-premises banking and form part of a market building or form a remote self-contained unit. In each of these situations this invention helps achieve an enclosure having a minimal facility space to be occupied.

The foregoing description of an embodiment of the invention is illustrative and not limiting. Various modifications and other embodiments will be apparent to those skilled in the art. For example, the low-friction bearing pads 66 may be constructed of other materials and, in place of pads, may employ rotatable bearings such as ball bearings when appropriate. Various forms of variable couplings and guides may be used in place of the bearing and track construction. In addition, the bearing and track of each of the guides and variable coupling may be interchanged in relative position. The appended claims are intended to cover such modification as are encompassed by the scope of this invention.

What is claimed is:

1. Security apparatus for a transaction processing machine comprising:

a walled enclosure;

and means for mounting a transaction processing machine within said enclosure;

said enclosure including means for providing user access through a wall of said enclosure to an operating interface of said machine, said means for mounting including: (a) means for turning said machine about an axis within said enclosure to a position for service access within said enclosure at another portion of said machine, said axis being movable during turning, and (b) coupling means between said machine and said enclosure for guiding said axis to move transversely of itself during turning of said machine.

2. Security apparatus for a transaction processing machine comprising:

a walled enclosure;

and means for mounting a transaction processing machine within said enclosure;

said enclosure including means for providing user access through a wall of said enclosure to an operating interface of said machine, said means for mounting including means for turning said machine about an axis within said enclosure to a position for service access within said enclosure at another portion of said machine, said axis being movable during turning and said means for turning including a movable carrier for said machine, means providing for said carrier a pivot movable in a prescribed path during turning;

and means for guiding said carrier to turn about said pivot in a certain path.

3. Security apparatus as set forth in claim 2 wherein said turning means further includes motor means, and means for variably coupling said motor means to said carrier.

4. Security apparatus as set forth in claim 3 wherein said means for mounting includes a base, and means for supporting said carrier on said base for turning movement thereon;

said means providing a pivot includes interacting means on said carrier and base forming said movable pivot, said means for guiding includes interacting means on said carrier and base for determining the guided path.

5. Security apparatus as set forth in claim 4 wherein each of said interacting means includes a track and a bearing with one fixed to said carrier and the other fixed to said base.

6. Security apparatus as set forth in claim 4 wherein said means for variably coupling includes interacting means on said carrier and base for transmitting the motor drive to said carrier as said carrier varies in position in said guided path.

7. Security apparatus as set forth in claim 6 wherein said interacting means for variably coupling includes a track and a bearing with one fixed to said carrier and the other rotatable on said base.

8. Security apparatus as set forth in claim 4 wherein said means for supporting said carrier includes low friction pads between said carrier and base and fixed to one thereof enabling sliding movement of said carrier in said guided path.

9. Security apparatus for a transaction processing machine comprising:

a walled enclosure;

and means for mounting a transaction processing machine within said enclosure;

said enclosure including means for providing user access through a wall of said enclosure to an operating interface of said machine, said means for mounting including means for turning said machine about an axis within said enclosure to a position for service access within said enclosure at another portion of said machine, said axis being movable during turning, said enclosure wall including a window through which the operating interface of said machine projects in a position for normal operation, said means for turning including means for so guiding the path of movement of said machine that a corner of said machine passes out of said window and back therethrough into said enclosure to said service-access position.

10. Security apparatus as set forth in claim 9 wherein said means for guiding the path of machine movement guides said window corner to turn from said service-access position out of said window and back to said normal-operation position.

11. Security apparatus as set forth in claim 10 wherein said window includes a closure movable across said window when said machine is turned to said service-access position, and movable away from said window when said machine is turned to said normal-operation position.

12. Security apparatus as set forth in claim 11 and further comprising selectively operable means for automatically controlling the turning of said machine to said service-access position followed by the moving of said closure across said window, and selectively operable means for automatically controlling the moving of said closure out of said window and the turning of said machine to said normal-operation position.

13. Security apparatus as set forth in claim 9 wherein said enclosure has a wall opposite said window wall;

wherein said means for guiding the path of machine movement includes means for constraining movement of another corner of said machine diagonally opposite said window corner to largely move close to said opposite wall during turning of the machine between said positions.

14. Security apparatus as set forth in claim 13 wherein said means for constraining movement of another corner constrains said another corner to move largely parallel to said opposite wall.

15. Security apparatus as set forth in claim 13 wherein said enclosure is generally rectangular with an entranceway and service area towards one end, and said means for constraining movement of another corner also is effective to guide movement of a third intermediate corner to a path reducing the cul-de-sac space between said machine and an end wall between said window and opposite walls.

* * * * *